US008074453B2

(12) United States Patent
Gerendas et al.

(10) Patent No.: US 8,074,453 B2
(45) Date of Patent: Dec. 13, 2011

(54) COMBUSTION CHAMBER LINING

(75) Inventors: Miklos Gerendas, Am Mellensee (DE); Sermed Sadig, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 519 days.

(21) Appl. No.: 12/318,259

(22) Filed: Dec. 23, 2008

(65) Prior Publication Data

US 2009/0193810 A1 Aug. 6, 2009

(30) Foreign Application Priority Data

Dec. 27, 2007 (DE) ..... 10 2007 062 699

(51) Int. Cl.
*F02C 1/00* (2006.01)

(52) U.S. Cl. ..... 60/753

(58) Field of Classification Search ..... 60/752–760; 431/243, 253
See application file for complete search history.

(56) References Cited

U.S. PATENT DOCUMENTS

| | | | | |
|---|---|---|---|---|
| 3,956,886 | A * | 5/1976 | Sedgwick | 60/753 |
| 4,269,032 | A | 5/1981 | Meginnis | |
| 4,838,031 | A | 6/1989 | Cramer | |
| 5,083,424 | A | 1/1992 | Becker | |
| 6,047,552 | A | 4/2000 | Gross | |
| 6,155,055 | A * | 12/2000 | Forestier | 60/747 |
| 6,276,142 | B1 | 8/2001 | Putz | |
| 6,514,046 | B1 | 2/2003 | Morrison | |
| 6,675,586 | B2 | 1/2004 | Maghon | |
| 6,786,048 | B2 | 9/2004 | Tiemann | |
| 7,051,531 | B2 | 5/2006 | Tiemann | |
| 2009/0071160 | A1 * | 3/2009 | Keller et al. | 60/753 |

FOREIGN PATENT DOCUMENTS

| | | | |
|---|---|---|---|
| DE | 197 27 407 | A1 | 1/1991 |
| DE | 197 30 751 | A | 1/1998 |
| EP | 12 84 390 | A1 | 2/2003 |
| EP | 14 31 661 | A1 | 6/2004 |
| WO | WO 98/13645 | A | 4/1998 |
| WO | WO 01/55273 | A | 8/2001 |

* cited by examiner

*Primary Examiner* — Louis Casaregola
*Assistant Examiner* — Phutthiwat Wongwian
(74) *Attorney, Agent, or Firm* — Timothy J. Klima; Shuttleworth & Ingersoll, PLC

(57) ABSTRACT

A combustion chamber for a gas turbine has a metallic supporting structure 6 and several circumferentially distributed ceramic bodies 2 attached to the supporting structure 6. The ceramic bodies 2 each have a straight hollow tubular profile and are arranged as individual segments At least one hollow metallic body 1 having air-passage holes 5 for the passage of cooling air is provided in each ceramic body 2.

20 Claims, 4 Drawing Sheets

COMBUSTION CHAMBER LINING

Figure 1:
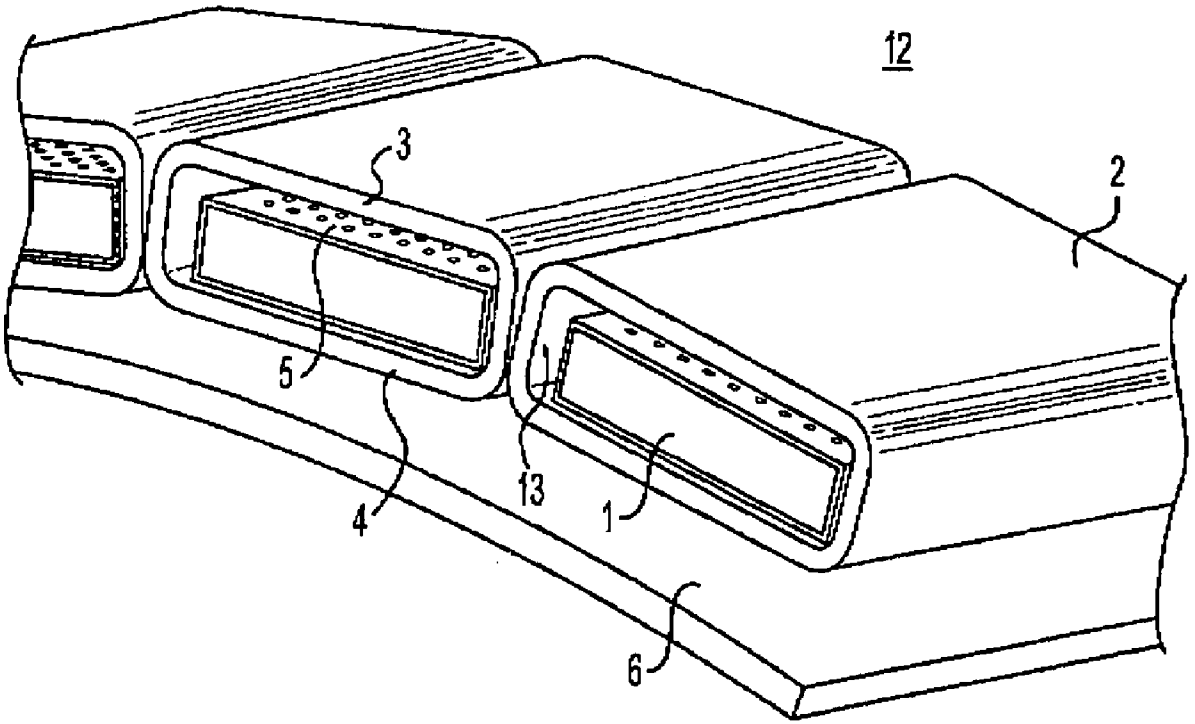

This application claims priority to German Patent Application DE102007062699.3 filed Dec. 27, 2007, the entirety of which is incorporated by reference herein.

The present invention relates to a combustion chamber for a gas turbine.

More particularly, this invention relates to a combustion chamber for a gas turbine with a metallic supporting structure and several, circumferentially distributed ceramic bodies of hollow profile attached to the supporting structure.

The state of the art is known from Specification DE 195 02 730 A1. Specification DE 195 02 730 A1 describes the ceramic lining of a combustion chamber with at least one uncooled wall plate of high-temperature resistant structural ceramics and being spring-elastically connected to a retaining device by a fastener. The joining surface between fastener and ceramics is formed such that only minimum thermal stress occurs.

Disadvantageously, the metallic wall can be cooled only by convection requiring a high cooling-air mass flow. Moreover, the fastener is exposed to increased thermal load as it rests on the side facing the hot gas.

Specification EP 0 943 867 B1 describes the ceramic lining of a combustion chamber with individual segments arranged side-by-side in the form of hollow chambers, with these chambers being also usable for flow conduit. The ceramic lining can be attached on the side disposed towards the metallic structure.

While, in this solution, the cavity can also be used for flow conduit, thus obtaining higher heat transfer rates, this cooling technique is limited to convection cooling of the ceramic wall element disposed towards the combustion chamber interior. Also, it is not evident in what way the cooling air is metered, and, furthermore, the control of the local cooling-air mass flows in the continuous cavity is considered as problematic. It is further disadvantageous that the entire axial building length must be made in one part. Accordingly, any bends must be integrally incorporated in one piece.

Both pre-known solutions are disadvantageous in that resiliently borne, elastic fasteners are used. With the known oscillations in an engine and the correspondingly high pressures, this leads to vibration as in a spring-mass-oscillation system.

It is a broad aspect of the present invention to provide a gas-turbine combustion chamber of the type specified at the beginning which, while being simply designed and easily and reliably usable can be manufactured cost-effectively and avoids the disadvantages of the state of the art.

The present invention accordingly provides for a plurality of ceramic bodies to line the combustion chamber with the ceramic bodies having hollow tubular profiles, and each being straight and the plurality being arranged as individual segments. A hollow metallic body is provided in each hollow ceramic body, which metallic body preferably has the shape of a hollow box. On at least one wall, air-passage holes are provided on the metallic body which can have the form of a perforation. Cooling air introduced into the metallic body exits through these air-passage holes.

The metallic body is preferably arranged such in the interior of the hollow ceramic body that an interspace is formed therebetween, enabling cooling air flowing through the air-passage holes in the metallic body to distribute in the interior of the ceramic body.

The ceramic body can preferably be provided with additional air-passage holes on its wall disposed towards a combustion chamber.

The air-passage holes (perforation) of the metallic body are preferably provided on the wall disposed towards the combustion chamber interior to ensure effective cooling of the ceramic body.

Preferably, the metallic body is connected to a cooling-air system via a cooling-air supply line. Thus, cooling-air leakage is avoided.

It is particularly favorable if the ceramic body is provided as a straight profile and if several such ceramic bodies are segmentally arranged on the wall of the combustion chamber to form the curved contour of the combustion chamber.

Figure 2:
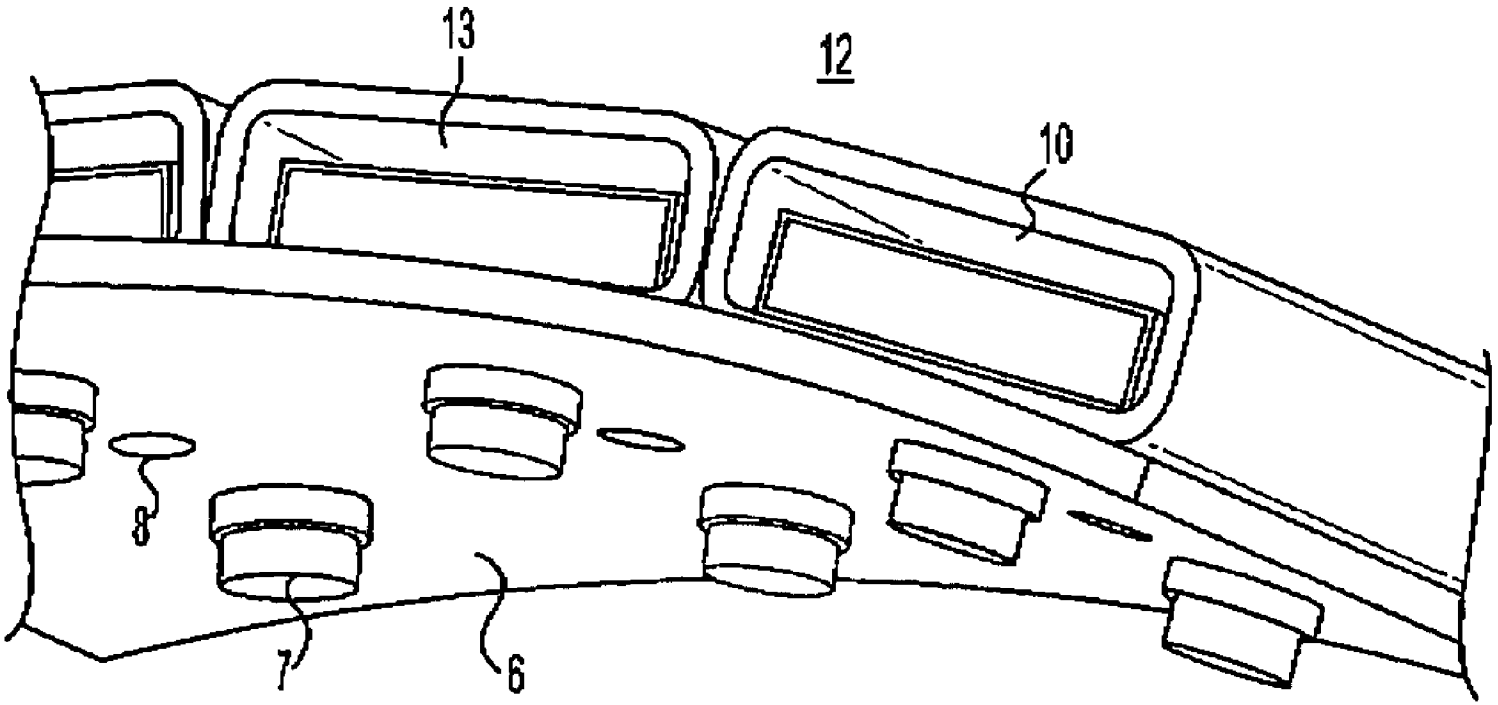
Figure 3:
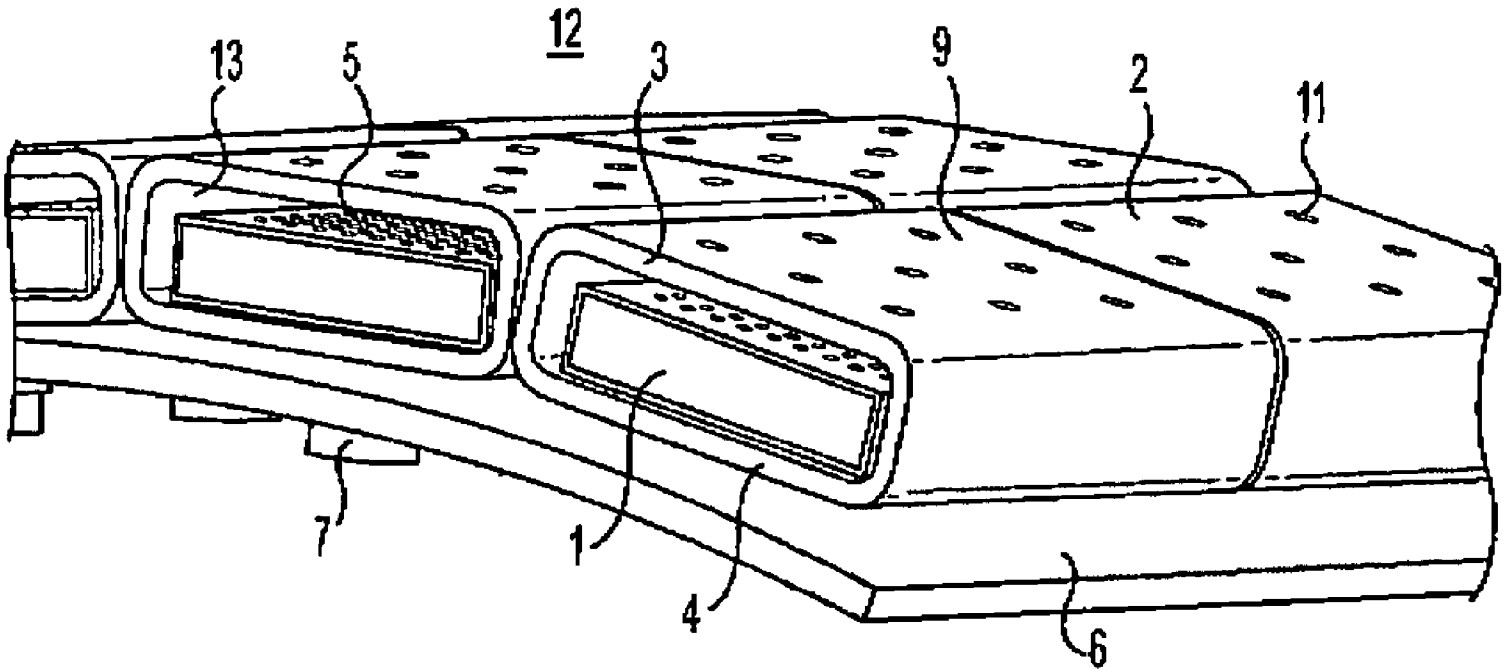
Figure 4:
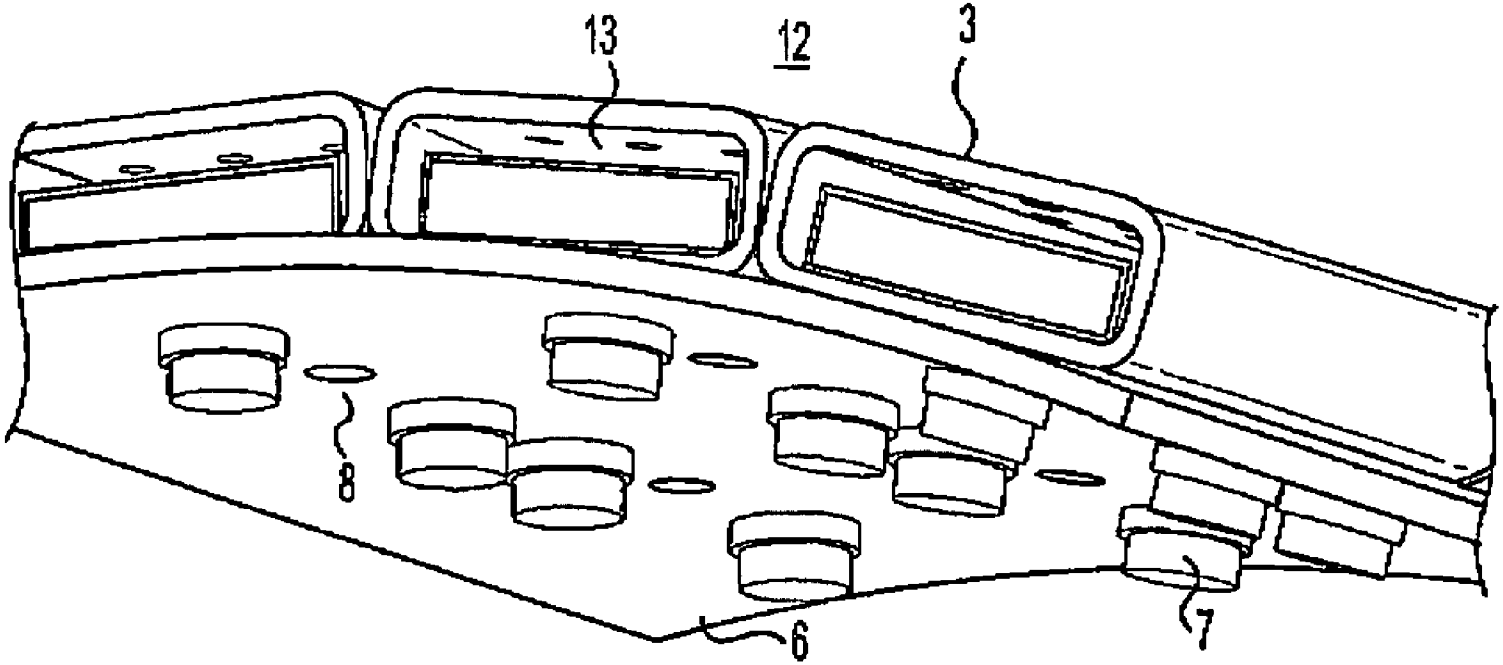

The present invention is more fully described in light of the accompanying drawings showing preferred embodiments. In the drawings, FIG. 1 is a perspective partial view of a combustion chamber lining in accordance with the present invention, FIG. 2 is a perspective underside view of the arrangement shown in FIG. 1, FIG. 3 is a modified embodiment, analogically to the representation of FIG. 1, and FIG. 4 is a perspective underside view of the arrangement as per FIG. 3.

In the present invention all embodiments are described in conjunction with FIGS. 1 to 4.

The present invention accordingly provides for lining a metallic supporting structure 6 with circumferentially and axially segmented ceramic bodies 2 having hollow tubular profiles producible from a longer section of a straight profile. The ceramic bodies can be arranged as circumferential bands axially spaced along the combustion chamber. In the cavity 10 of each hollow ceramic body 2, a unilaterally perforated air-flown hollow metallic body/box 1 is provided which, together with a support side 4 of the ceramic body 2, is attached to the metallic supporting structure 6 by one or more fasteners 7.

For attachment, a corresponding fastener according to Specification U.S. Pat. No. 4,512,699 (daze fasteners) is proposed, but any fastener with stress-free operational characteristics will also be suitable.

Provided in the metallic supporting structure 6, the ceramic body 2 and the metallic body 1 is a cooling-air supply line 8 which is located as close as possible to the fastener if one fastener is provided and as centrally as possible between fasteners if several fasteners are provided.

The hollow metallic body 1, which subsequently is flown by the cooling air, serves for cooling-air control. The air-passage holes (perforation) 5, which define the flow-determining surface, enable an adequate cooling-air quantity to be set in the respective area of the ceramic body 2 therefore provided. Since the metallic body 1 is closed and provided with a cooling-air supply line 8 and the air-passage holes 5 only, no leakage flow will occur.

The cooling air, which exits from the metallic body 1 into an interspace 13 between the metallic body 1 and the ceramic lining 3 of the ceramic body 2, impinges on the rear side of the ceramic lining 3, thus considerably increasing heat transfer. Subsequently, the air exits at the ends of the ceramic body 2 and, owing to the axial segmentation, can be used for film cooling of the ceramic surface disposed towards the hot gas, but also as protection of the metallic structure against hot-gas impact into the gaps. Also advantageous is a perforation 11 of the hot-gas side ceramic surface 9.

The unilaterally perforated air-flown hollow metallic body 1 provides for controlled distribution of the cooling air in the combustion chamber wall. Parasitic leakage flows will not occur. The perforation of the hollow metallic body 1 enables the rear of the ceramic surface 9 disposed towards a combustion chamber interior 12 to be impingement-cooled. This significantly increases heat flux from the wall. Additional perforation of the ceramic surface 9 enables the cooling efficiency to be further enhanced. If the holes for cooling-air supply are located as close as possible to the fasteners, leakage flows along the gaps between the individual components cannot occur. The segmentation enables universally applicable ceramic components to be produced which are usable in combustion chambers of any size and shape.

LIST OF REFERENCE NUMERALS

1 Metallic body/box with hollow interior
2 Ceramic body having hollow tubular profile/segment
3 Hot gas-side ceramic wall
4 Support-side ceramic wall
5 Perforation/air-passage hole
6 Metallic supporting structure/support
7 Fastener
8 Cooling-air supply line
9 Ceramic surface/wall
10 Cavity
11 Air-passage hole
12 Combustion chamber interior
13 interspace

What is claimed is:

1. A combustion chamber for a gas turbine, comprising:

a metallic supporting structure;

a plurality of circumferentially distributed ceramic bodies attached to and at least partially lining a combustion side of the supporting structure to protect the supporting structure from combustion heat of the combustion chamber, each ceramic body having a hollow tubular profile; and at least one metallic body positioned on an interior wall of each ceramic body, the metallic body having a wall surrounding a hollow interior thereof and at least one first air-passage hole in the wall for passing cooling air from the hollow interior of the metallic body to the interior of the ceramic body.

2. The combustion chamber of claim 1, wherein the metallic body is arranged such in the interior of the ceramic body that an interspace is formed therebetween.

3. The combustion chamber of claim 2, wherein the ceramic body includes a wall disposed towards a combustion chamber interior and at least one second air-passage hole positioned in the wall to flow air from the interior to an exterior of the ceramic body.

4. The combustion chamber of claim 3, wherein the wall of the metallic body is disposed towards the combustion chamber interior and the at least one first air-passage hole is positioned to flow air from the interior of the metallic body to the interspace.

5. The combustion chamber of claim 4, wherein there is a plurality of first and second air-passage holes in each metallic body and ceramic body and such air passage holes are provided as perforations of the metallic body and the ceramic body.

6. The combustion chamber of claim 5, and further comprising at least one fastener to attach each ceramic body and metallic body to the supporting structure.

7. The combustion chamber of claim 6, and further comprising at least one cooling-air supply line connecting each metallic body to a cooling-air system.

8. The combustion chamber of claim 7, wherein each ceramic body has a straight profile.

9. The combustion chamber of claim 8, wherein each metallic body is enclosed such that cooling air is introduced to the interior of the metallic body only via the cooling-air supply line and discharged from the interior of the metallic body only via the first air-passage holes.

10. The combustion chamber of claim 1, wherein the ceramic body includes a wall disposed towards a combustion chamber interior and at least one second air-passage hole positioned in the wall to flow air from the interior to an exterior of the ceramic body.

11. The combustion chamber of claim 10, and further comprising at least one cooling-air supply line connecting the interior of each metallic body to a cooling-air system.

12. The combustion chamber of claim 11, wherein each metallic body is enclosed such that cooling air is introduced to the interior of the metallic body only via the cooling-air supply line and discharged from the interior of the metallic body only via the at least one first air-passage hole.

13. The combustion chamber of claim 10, wherein there is a plurality of first and second air-passage holes in each metallic body and ceramic body and such air passage holes are provided as perforations of the metallic body and the ceramic body.

14. The combustion chamber of claim 1, and further comprising at least one fastener to attach each ceramic body and metallic body to the supporting structure.

15. The combustion chamber of claim 1, and further comprising at least one cooling-air supply line connecting each metallic body to a cooling-air system.

16. The combustion chamber of claim 15, wherein each ceramic body has a straight profile.

17. The combustion chamber of claim 1, wherein each metallic body is enclosed such that cooling air is introduced to the interior of the metallic body only via a cooling-air supply line and discharged from the interior of the metallic body only via the at least one air-passage hole.

18. The combustion chamber of claim 1, wherein the ceramic bodies are arranged in a plurality of separate circumferential bands axially spaced along the combustion chamber.

19. The combustion chamber of claim 5, wherein the ceramic bodies are arranged in a plurality of separate circumferential bands axially spaced along the combustion chamber.

20. The combustion chamber of claim 9, wherein the ceramic bodies are arranged in a plurality of separate circumferential bands axially spaced along the combustion chamber.

* * * * *